United States Patent [19]

Itaya et al.

[11] Patent Number: 4,843,425

[45] Date of Patent: Jun. 27, 1989

[54] IMAGE FORMING METHOD AND APPARATUS

[75] Inventors: Masahiko Itaya, Akishima; Tetsuya Niitsuma; Syuzi Okamoto, both of Hachioji, all of Japan

[73] Assignee: Konishiroku Photo Industry Co., Ltd., Tokyo, Japan

[21] Appl. No.: 94,907

[22] Filed: Sep. 10, 1987

[30] Foreign Application Priority Data

Sep. 12, 1986 [JP] Japan ..... 61-21630
Nov. 13, 1986 [JP] Japan ..... 61-270224
Jan. 19, 1987 [JP] Japan ..... 62-9754

[51] Int. Cl.[4] ..... G03G 15/01

[52] U.S. Cl. ..... 355/261; 355/77; 355/326; 430/42

[58] Field of Search ..... 355/4, 3 R, 3 CH, 77; 430/42, 44, 31

[56] References Cited

U.S. PATENT DOCUMENTS 3,892,481 7/1975 Schaefer et al. ..... 355/10

*Primary Examiner*—R. L. Moses

*Attorney, Agent, or Firm*—Finnegan, Henderson, Farabow, Garrett and Dunner

[57] ABSTRACT

A method and an apparatus to prevent toner particles on the surface of the photoreceptor from splashing when a multilayer image of toner particles is formed by repeating of an electrophotographic process including electrification, exposure and development of the surface of the photoreceptor. An electric field is established by electrode means between it and the photoreceptor to repel toner particles from the electrode means at least when the photoreceptor is exposed subsequent to the first exposure.

16 Claims, 9 Drawing Sheets

IMAGE FORMING METHOD AND APPARATUS

BACKGROUND OF THE INVENTION

The present invention relates to an apparatus and a method for practicing an image-forming process wherein a multilayer image is obtained on a photosensitive surface by an electrophotographic process and, more particularly, where such an apparatus and process prevents the splashing of toner during the exposure of the photosensitive surface at times subsequent to the first.

In the art of photo-reproduction a multi-color image is obtained by building-up multiple layers of toner; each layer of toner corresponding to a separate color. A photosensitive body, usually in the form of a drum, is electrified. The drum is then exposed to an image which disturbs its electrification in selected areas corresponding to the image. A toner, having an electric charge, is then applied to the surface of the drum and is repelled, due to its charge, from areas on the drum not corresponding to the image. This process may be repeated two or more times for two or more color toners to be applied. The individual layers of toners assume homopolarity by said electrification and are so repulsed by each other as to cause each to splash and to attach to and stain any part in the machine where there is a degree of Coulomb force in action caused by even the slighest potential difference. This defect causes a degredation of image quality through uneven exposure or fogging of images. The splashes are most conspicuous in reversal process as expalined below.

Exposure of an image is done by scanning of the photosensitive surface of the drum with a light image, having laser or LED as the light source, to form a static latent image on the drum which is developed by a toner comprised of chargeable particles. Since the blank area on the drum is much larger than the area covered with toner in an ordinary image, exposure of light to the blank area raises several problems. The life of the light source and the life of the image-forming body are shortened. Further, uneven scanning in the optical system produces lines in the blank area. For this reasons it is common practice to irradiate the colored part and not to apply light to the blank area when a latent image is formed. In this case, unlike the process in copying machines, a latent image is formed with a low potential in the colored area and a high potential in the blank area, thus the development is performed in a reversal process whereby the tone attaches to the low potential area of the latent image.

FIG. 1 illustrates, that when such a reverse development process is practiced, the inadequancy of the adhesiveness of the toner attaching to the image portion and how easily the toner splashes. FIG. 1(*a*) shows the condition following the first cycle of image exposure and development, wherein the development under a predetermined development bias causes the toner to attach to the image area where the electrical potential on the photosensitive body 1 is close to ground potential. FIG. 1(*b*)shows the condition when the second image exposeure is being carried out at a position close to the image area to which the toner is attached. A laser beam L, used for exposing the second image, has disturbed the electric field adjacent to the toner attaching to the image and caused the toner to become instable resulting in the removal or splashing of its particles.

FIG. 1(*c*) shows the condition of the exposure unit immediately after the secxond image exposure, wherein the laser beam, L, has caused part of the toner to splash and attach to a write unit 3 which is grounded and positioned facing an image unit 2.

Referring now to FIG. 2, there is now explained the cause of the toner splashing shown in FIG. 1.

In FIG. 2(*a*) through (*e*) a negative potential on the surface of photosensitive body is taken on the vertical axis and a position on the surface of a photosensitive body is taken on the horizontal axis. While the charge on the surface of the photosensitive body is shown in FIGS. 1 and 2 as being negative it should be understood that such a charge may also be positive.

FIG. 2(*a*) shows that the surface of a photosentsitive body has been charge uniformly to minus E Volts by means of an electrifier.

FIG. 2(*b*) illustrates a state wherein a photosensitive body has been exposed to light for an area I where the electric potential has approached close to 0 Volts.

FIG. 2(*c*) illustrates the state of development that, when the area I of exposure passes the developing device, a negatively charge toner is propelled from a developing sleeve. The toner has approximately the same potential as that of the uniformly charged potentail of the photosensitive body. It is propelled onto the area I of exposure on the photosensitive body and adheres thereto. The surface of the photosensitve body, where there is a toner image of the first color thus formed thereon, is uniformly charged agin for the second time by means of an electrifier. The first toner color image remains on the photosensitive body.

FIG. 2(*d*) shows the potential of the uniform charge for the second exposure cycle.

In the second cycle an image exposure takes place according to the image signals corresponding to the second color. FIG. 2(*e*) shows that the image is exposed to light at the area I'adhacent to the toner image of the first color. The potential at the area I' is lowered close to 0 volts. The potential at the area I' is higher than at the area I.

Each particle of the toner forming the toner image of the first color adheres to the surface of the photoreceptor because of the action of Coulomb forces. Electrically the toner particles, being charged with homopolarity, mutually repel each other. Since toner particles are negatively charged, a force to move the toner particles to a position higher in potential acts in the direction of the electric field formed there. If this force to move the toner particles is large, the toner jumps toward the area where the electric potential is large. FIG. 2(*f*) shows the state in which part of the toner attaching to the area I having a potential of —E Volts is jumping to move to the area I' whose potential is close to 0 Volts.

When a photoreceptor having a toner image thereon is exposed again for an image of a second color and toner jumps, part of the toner as it jumps impinges upon and attanches to the dust proof glass inside the image exposing device, lowering the transmissivity or causing unevenness of the exposure light as a result.

For the purpose of preventing toner from contaminating surfaces of the image forming apparatus, there have conventionally been provided an air stream directed into the apparatus to collect toner or direct it away, or use of a screen or brush, to remove umwanted toner particles or a sheet or a lid to shut off toner where necessary.

However, the application of an air stream to prevent umwanted toner particle attachment has raised problems in that various items of machinery, such as a fan, duct, filter are needed to collect loose toner particles. This makes the apparatus large, expensive and noisy. The use of a screen or brush has involved a problem that a screen can not be effectively employed in an exposure unit where toner splashes most. Similarly, slit or lid cut-offs are ineffective.

SUMMARY OF THE INVENTION

The present invention overcomes the promblems and disadvantages of the prior art by providing an image forming apparatus for forming mult-color images wherein the exposure unit permits multiple layers of toner to be established on a photosentsitive surface without the layers interfering with each other and without undesired splashing onto adjacent components.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The achieve the objects and in accordance with the purpose of the invention, as embodied and described herein, the image forming method of this invention for forming a multilayer image of toner particles comprises:

Electrifying the surface of a photoreceptor, exposing the surface of the photoreceptor to exposure light, developing the surface of the photoreceptor, repeating the steps of electrifying, exposing and developing a plurality of times, and establishing an electric field to prevent toner particles on the surface of the photoreceptor for splashing when said step of repeating said step of exposing is done for a first and subsequent times.

Also to achieve the objects and in accordance with the purpose of the invention, as embodied and described herein, an image forming apparatus is provided for forming a multilayer image of toner particles on the surface of a photoreceptor comprising: electrifier means for electrifying the surface of the photoreceptor, exposure means for exposing the surface of the photoreceptor to exposure light, one or more developing means for supplying toner particles to the surface of the photoreceptor, and electrode means spaced from the photoreceptor being operable to establish an electric field between it and the photoreceptor to repel toner particles from the electrode means.

The accompanying drawings, which are incorporated in and constitute a part of this specification, illustrate one embodiment of the invention and, together with the description, serve to explain the principles of the invention.

BRIEF DESCRIPTION OF THE DRAWING

FIg. 4-B is a time chart illustrating the sequence of forming an image in accordance with the present invention;

DESCRIPTION OF THE PREFERRED EMBODIMENT

Reference will now be made in detail to the present preferred embodiment of the invention, an example of which is illustrated in the accompanying drawings.

Figure 3:
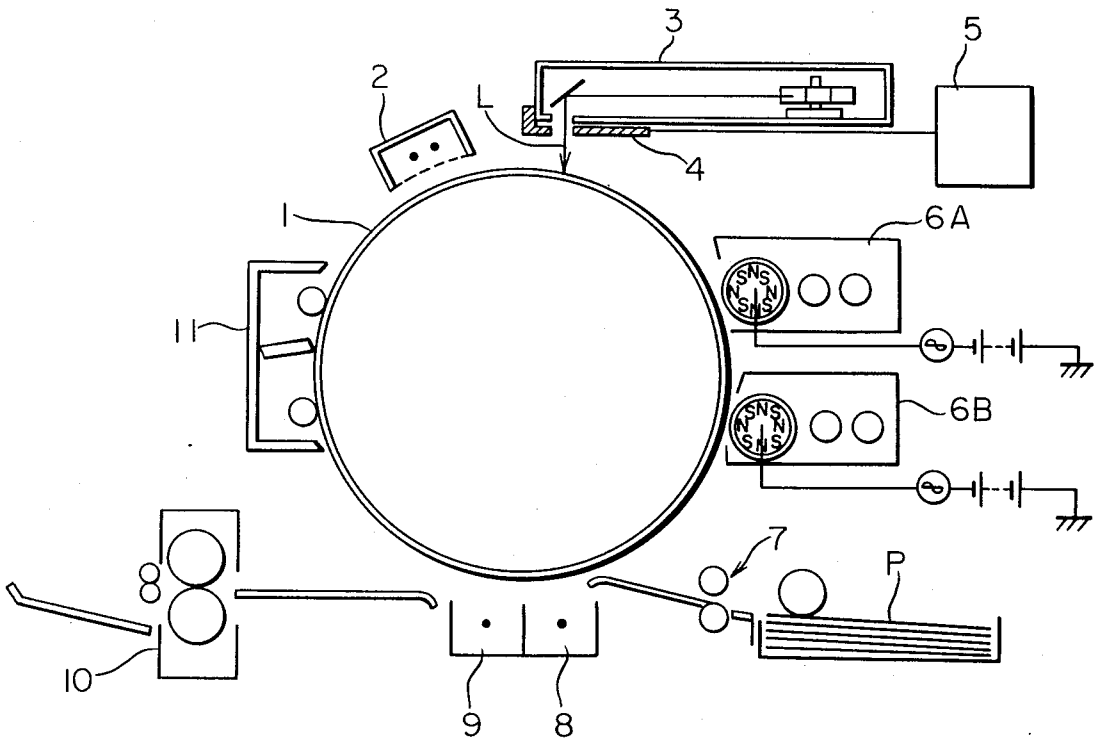
FIg. 3 is a schematic block diagram of an image forming apparatus in accordance with the present invention.

The preferred embodiment of the image forming apparatus is shown in FIG. 3. This image forming apparatus includes means for preventing toner particles from splashing.

FIG. 3 shows multilayer image-forming apparatus wherein two developers are used. It should be understood that the practice of the present invention is not restricted by the number of developers nor the number of the colors of toners used. Further, this invention is applicable to cases where the same color toner is used overlapping as well.

FIG. 3 shows a multi-color image-forming apparatus for two colors as an embodiment of the invention, but the basic principle is the same for a multi-color apparatus for three or more colors only with an increased number of developers used.

FIG. 3 shows a multilayer image-forming apparatus wherein two developers are used as another embodiment, but the practice of the present invention is not restricted by the number of developers nor by the number of the colors of toners used. Needless to say, this invention is applicable to cases where the same color toner is used overlappingly as well.

In the drawings the reference numbers have the following meansings: 1 denotes a photoreceptor in the shape of a drum; 2 denotes an electrifier; 3 denotes an exposure unit; 4 denotes an electric pole for preventing toner from splashing as a means for preventing toner from splashing; 5 denotes a power source to supply a voltage to the electric pole for preventing toner from splashing; 6A and 6B each denote a developer; 7 denotes a paper feeding means to supply transfer paper, P; 8 denotes transfer means equipped with transfer electric pole for transferring a toner emage from a photoreceptor 1 onto transfer paper, P; 9 denotes separating means equipped with a separating electric pole to separate transfer paper P having a toner image thereon from a photoreceptor 1; 10 denotes fixing means to fix a toner image on a transfer paper; 11 denotes a cleaning device to clear off residual toner on a photoreceptor 1, and L denotes laser light for exposure projected onto a photoreceptor 1.

Figure 4:
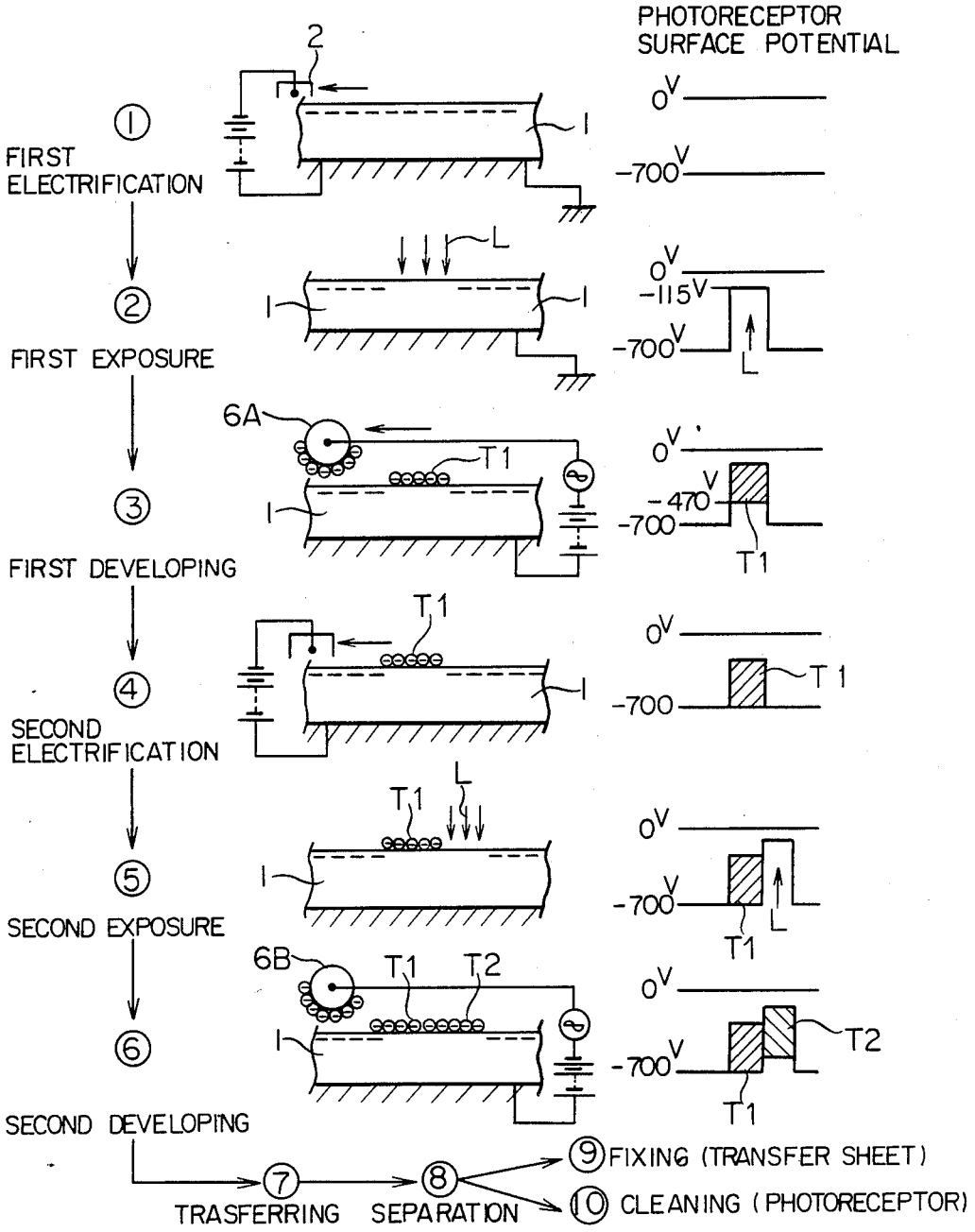
FIG. 4-A is a flowchart expalining the process of forming an image in accordance with the present invention.
Figure 5:
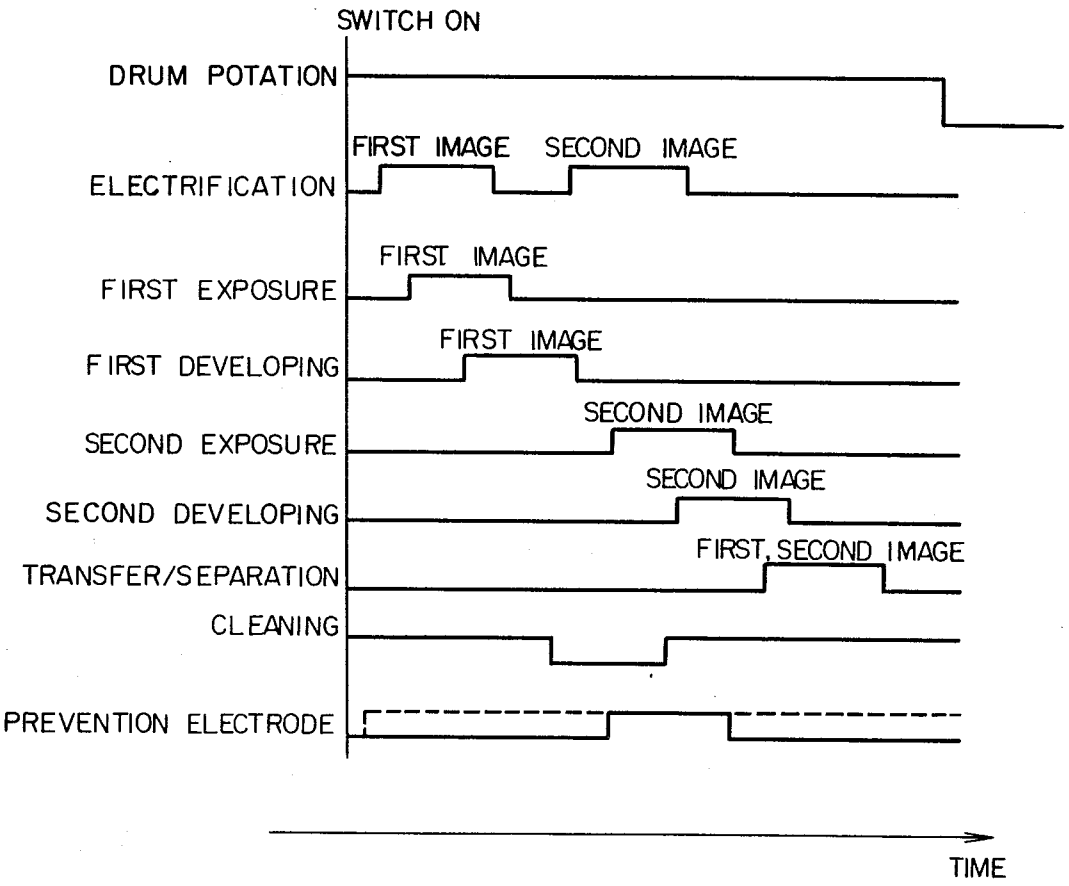

Referring now to FIGS. 4-A and 4B, there is now expalained a method for forming images having means for prevention toner from splashing as a preliminary step to the description of such means:

(1) The surface of a photoreceptor 1 is uniformly electrified by an electrifier 2 as the photoreceptor 1 begins to rotate for image formation (negatively polarized by a charge in this example).

(2) The exposure of the charger photoreceptor 1 for an image corresponding to the first picture image with a laser light, L, at the time shown by FIG. 4-B causes the picture image exposed to the laser light, L, to be discharged and to form a static latent image.

(3) This static image causes the reversal development of the first color to be carried out by a developer 6A and toner T1 being negatively polarized through friction with a carrier to attach to the are which was discharged as above. The photoreceptor 1 continues to rotate further without activation of a developer 6B, transfer device 8, separator 9 and cleaning device 11 at this stage.

(4) The image developed causes the photoreceptor 1 having the above-mentioned first picture image in toner to be reelectrified by an electrifier 2, the image assuming the same potential both at the parts represented in toner and not in toner.

(5) The exposure for the second picture image takes place, causing the area under exposure to be discharged. At this stage, a static latent image and a toner image related thereto exist on the photoreceptor, and two overlapping, close to each other in position, or the like.

(6) The reversla development of the second picture image is carried out by a developer 6B and toner T2 of the second color attaches to the area which was discharged as mentioned above.

(7) transfer paper P is provided to the transfer unit by a paper feeding means and the toner image of the respective first and second picture images is transferred onto a transfer paper P by a transfer device 8.

(8) The transfer paper P which a toner image combining the first and second picture images therein is separated from the photoreceptor 1 by a separator 9.

(9) The transfer paper P, now having a toner image thereon, is conveyed to a fixed 10, has the image fixed, and is discharged from the apparatus.

(10) The photoreceptor 1, following separation of the transfer paper P, is cleaned by a cleaning device 11 and made ready for the succeding image formation An electrifier 2 suitable for the use in this application above is one having potential controllability, such as a scoroton discharger. Developers 6A and 6B suitable for the use in this application are of the non-contact type, consisting of a magnetic roller and developing sleeves circumferentially located about the magnetic roller. Such developers are capable of development without contact of the developing agent with the photoreceptor 1 by applying a superimposed direct current voltage as a bias development voltage. This is especially desirable in developer 6B since a first toner image has been developed by developer 6A prior to the operation of developer 6B to develop a second, subsequent, image.

Figure 5:
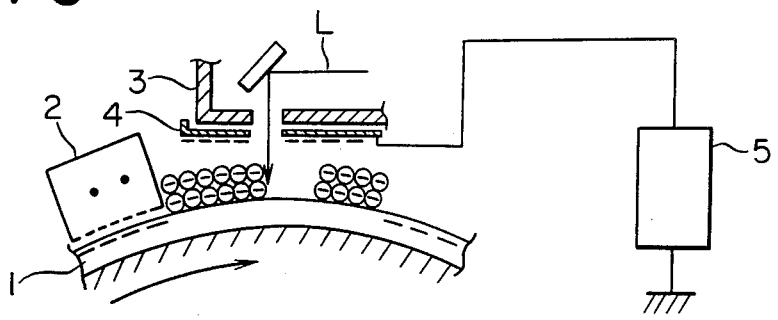
FIg. 5 is an embodiment of an electrode for use in an image forming apparatus in accordance with the present invention.

The present invention proposes, in a process of image exposure for the second picture image, or later cycles of exposure in multi-color picture image formation as described above, to form an electric field which causes the toner image of the first picture image to be electrically directed in the direction of the surface of the photoreceptor. The formation of the electric field is accomplished by providing an electric pole for prevention toner from splashing and by applying a voltage of the same polarity as the toner. An electric pole, or electrode, for preventing toner from splashing 4 is provided at the point where required, in the example at a position facing the photoreceptor 1 in an exposure unti and where toner frequently splashes. The electric pole for preventing toner from splashing 4 consists of a plate-shaped conductive material, that has an opening for the exposure light, and prevents toner from splashing by application of a voltage of the same polarity as the toner thereto from a power source 5. When a reversal development is carried out, the voltage applied is of the same polarity and the same value as or a value a little higher than the surface potential of the photoceptor 1 which has been uniformly charged by an electrifier 2 as shown in FIG. 5.

Since toner splashes as the first toner image is exposed where the toner has been reelectrified, the electric pole for preventing toner from splashing requires application of the voltage simulataneously with exposure for the second picture image as shown in FIg. 4-B. The application of a voltage to the electric pole for preventing toner from splashing in the practice of the present invention is not restricted to the timing as shown in the example in FIG. 4-B, but can be extended to a longer period of time, including said timing in FIG. 4-B. A toner imageforming method provided with a means for preventing toner from splashing according to the present invention has proved effective and provides advantageous results, markedly reducing chances of toner attaching to mirrors, lenses, and such elements in the exposure unit and thus improving the picture quality and facilitating maintenance work as well.

The present inventors carried out tests on preventing toner from splashing by the using image exposure and under the comnditions shown in Table 1.

TABLE 1

| | |
|---|---|
| Process speed | 70 mm/sec |
| Photoreceptor potential | −700 V |
| a photoreceptor | organic photoreceptor, negative images formed |
| electrification | scorotron control |
| Image exposure | laser diode used 1 mW (on photoreceptor |
| Development | AC + DC, bias voltage applied, non-contact reversal development, 3 color development |

In a test for copying 2,000 sheets, with the electric pole for preventing toner from splashing ground and without applying a voltage thereto, there was attachment of toner in the quantity of 1 mg/cm$^2$.

Next, with applying a voltage of −800V, a value a little over the photoreceptor potential, to the electric pole for preventing toner from splashing, the attachment of toner became approximately 0 mg/cm$^2$.

Furthermore, it was recognized that, when the photoreceptor potential was changed, toned was prevented form splashing by aplication of a voltage which was of the same polarity as the photoreceptor potential and somewhat larger in absolute value than the photoreceptor potential to said electric pole for preventing toner from splashing.

The effect was the same with an alternating current voltage as with a direct current voltage as the power source.

There is now expalined hereunder an electric pole for preventing toner from splashing shown in FIG. 3 in detail.

Figure 6:
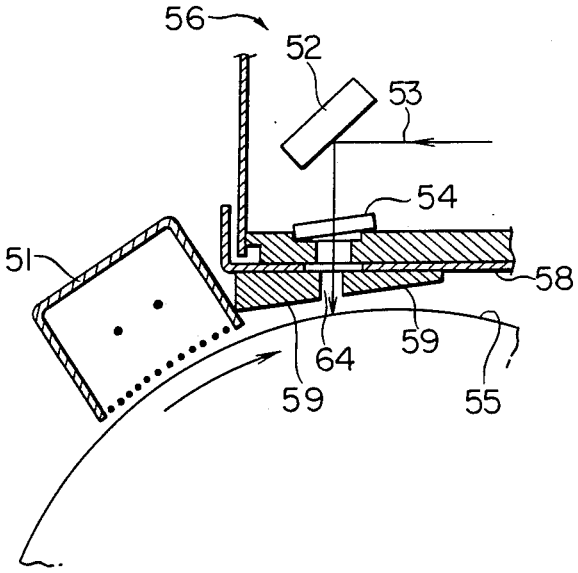
FIG. 6 is another embodiment of an electrode for use in an image forming apparatus in accordance with the present invention.

FIG. 6 illustrates an electric pole 59 having a slit 64, by which an electric field that prevents toner from splashing is formed between itself and the surface of the photoreceptor 55 when a voltage which is of the same polarity as the electrified photoreceptor and approximately the same in absolute value as or somewhat larger than the potential of the electrified photoreceptor 55 is applied to said electric pole 59. Not only said electric field prevents toner from splashing but also a force to draw back toward the photoreceptor 55 any toner which has splashed is exerted when a voltage which is somewhat larger in absolute value than the potential of the electrified photoreceptor 55 is applied.

It constitutes another advantage that the narrow passageway formed by the slit 64 makes it difficult for the splashes of toner to reach the dust-proof glass 54.

In FIG. 6 the electric pole 59 has a cross section in which the bottom surface is inclined relative to the circumference of the photoreceptor, but this bottom surface can be altered to a plane which is parallel with the upper surface without the least impairment of the effect.

Figure 7:
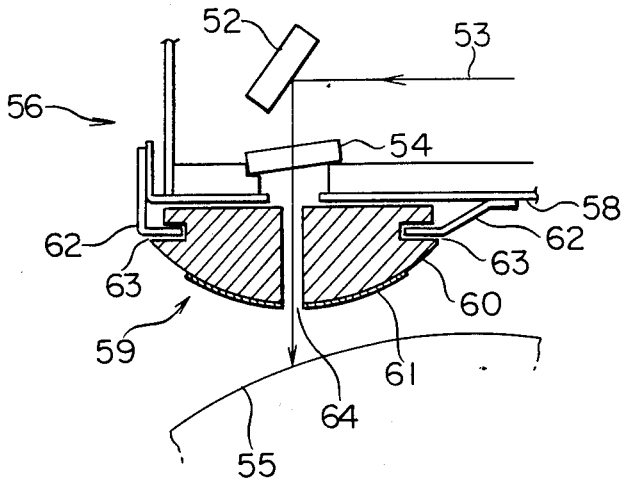
FIG. 7 is another emodiment of an electrode for use in an image forming apparatus in accordance with the present invention.

FIG. 7 illustrates an electric field-forming means whose cross-sectional shape is thick at the slit 64 and loses thickness in proportion to the distance from the slit 64, and this electric pole 59 has its conductive electric pole 61 on the bottom surface of a slit-forming member 60 made of a resin.

An electric pole 59 is so designed as to be mounted on the image-forming apparatus and dismounted therefrom freely from the front; it is slidably fixed in position by fitting the rails 62, 62 extending from the framework 58 of the image exposure unit 56 into the frooves 63, 63 in the electric pole 59.

In an electric pole of the above structure the intensity of an electric field is increased at and near the slit 64 so that toner is prevented from entering the slit 64. The amount of toner that enters the slit 64 and attaches to the inner wall of the slit 64 increases and, consequently, the amount of toner that attached to the dust-proof glass 54 decreases as the thickness of the slit 64 is increased. Often there are streams of air in the space between a photoreceptor 55 and an electric pole 59, caused by the rotation of the photoreceptor 55 or an exhaust fan, not shown, and the streamlined shape of the electric pole 59 helps to minimize turbulent flow of air at the electricole so that toner that is suspended in air can be prevented from attaching.

Though detailed investigations by the present inventors it was discovered that in the examples shown in FIG. 6 and FIG. 7 the electric pole 59 and the conductive electric pole 61 overhang the surface of the photoreceptor in such a way that an image force works between the conductive electric pole 61 and the charged toner which is in suspension nearby and part of the toner which splashes from the photoreceptor 55 attaches to said electric pole 59 and the conductive electric pole 61. Similarly, toner charged in opposite polarity, that exists in very small quantities also attaches. This raises a problem that, when the power switch of the apparatus is turned off or the apparatus is given a mechanical or physical impact the overlay of toner in piles may fall onto the photoreceptor or may destroy the toner image which is in the process of image formation or may smear the inside of the apparatus.

Another problem is that it is dangerours to repair or other-wire service the apparatus with the photoreceptor dismounted because of overhanging electric poles, etc.

Figure 8:
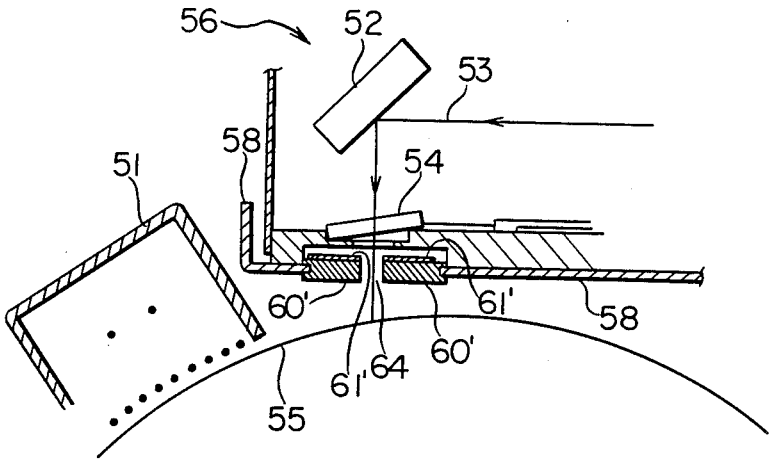
FIG. 8 is another embodiment of an electrode for use in an image forming apparatus in accordance with the present invention.

FIG. 8 illustrates a device which has been provided as a means to improve the electric pole for preventing toner from splashing and as a solution to the above-mentioned problems. A conductive electric pole as an electric pole for preventing toner from splashing is denoted by 61' and a slit member made of a resin as a dielectric, ahving a slit 64, is denoted by 60'.

The conductive electric pole 61' in this example consists of a conductive sheet. Said slit member made of a resin 60' and said conductive electric pole 61' are positioned between the dust-proof glass 54 of the image exposure unit 56 and the photoreceptor 55 with the conductive electric pole 61' on the side of the dust-proof glass 55.

A voltage of the same polarity as the electrified photoreceptor which is the same in absorlute value as or larger than the potential of the electrified photoreceptor is applied to the conductive electric pole 61' so as to form an electric field between said electric pole 61' and the photoreceptor 55 to prevent toner from splashing from the toner image on the photoreceptor 55. The slit member 60' made of a resin is fixed to the framework 58 in a structure resembling a rail in cross section and in such a position as to establish a gap approximately 5 mm from the surface of the photoreceptor 55. The split member 60' us slidable in the vertical directions relative to the drawing. Such slit members, therefore, are easy to mount and dismount from the front of the apparatus, hence offer an improvement in maintainability.

Figure 9:
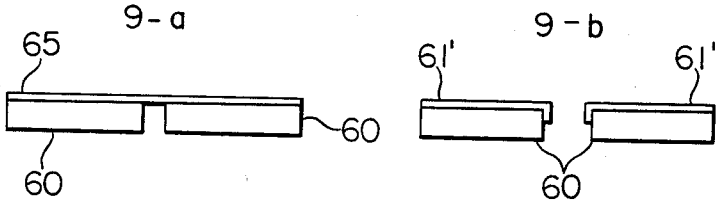
FIg. 9 illustrates an embodiment of an electrode disposed relative to a dielectric slit in accordance with the present invention.

FIG. 9 shows a different example of a slit member made of a resin 60 and one of an electric pole, FIG. 9-*a* representing an example which is of such a structure as to close even the slit by the use of transparent conductive membranous film 65. This contrivance perfectly bars toner from splashing and reaching the dust-proof glass. The example shown as FIG. 9-*b* is of such a structure as to prevent toner from passing through the slit by turing down the conductive electric pole 61' inwardly into the slit.

In an image-forming apparatus apparatus showing in FIG. 8 and FIG. 9 the electric pole unit is provided with a dielectric having a slit as a passageway for light for image exposure on the side of the photoreceptor. Toner which splashes from the surface of the photoreceptor is shut off by said dielectric and does not attach to the electric pole. The surface of the dielectric on the side of the photoreceptor is separated from the electric pole by the thickness of the dielectric and at this position the force with which toner is drawn is drawn to the dielectric and attaches is smaller than directly to the electric pole, and thus toner is difficult to attach.

The invention also provides added safety when an apparatus is serviced, the electric pole being shut off by the the dielectric from direct exposure from the side of the photorecptor. Thus, any chance of a worker or an object touching the electric pole even when the photoreceptor is not in place is precluded.

Figure 10:
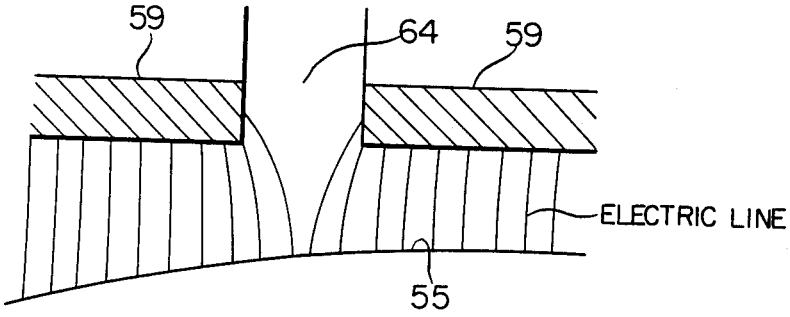
FIG. 10 is a schematic diagram of an electrode in accordance with the present invention in spaced relation to a photoreceptor.

The present inventors studied in detail the effect of the ekectric field at the mouth of the slit with respect to the example shown in FIG. 9. In the studies it was discovered that, when no electric pole was provided at the mounth of the slit as shown in FIG. 10, the electric field at the mouth is weaker than where provided with an electric pole for preventing toner from splashing as shown in the drawing, and therefore, raises a problem that toner that has flown to said mouth of the slit is not quite prevented from entering the interior of the slit. If the potential difference between the electric pole for preventing toner from splashing and the photoreceptor is enlarged in the attempt to prevent the toner from entering the slit, the attempt raises problems that toner, electrified with a reverse polarity, may attach to the electric pole for preventing toner from splashing or may be drawn into the slit.

To solve the above-mentioned problems the present inventors devised a method wherein an electric pole includes a transparent conductive membranous film which transmits exposure light at the slit between the dust-proof glass of an image exposure unit and the photoreceptor so that an electric field is formed within the slit or at the mouth of the slit and splashes of toner can be prevented from coming near to the mounth of the slit or from entering into the slit, and, if there are splashes of toner in the slit, the transparent conductive membranous film shuts off the splashes from reaching the dust-proof glass. The toner was also prevented from attaching to the transparent conductive membranous film itseft so that there can occur no decrease in the amount of exposure or unevenness in exposure in the above consideration.

With respect to the above consideration there is now explained embodiment of the prevent invention with reference to drawings. FIGS. 11 through 14 illustrate, as seen from one side of a slit, a transparent conductive membranous film, dielectric slit member, and an electric filed in the space relative to the positions of the photoreceptor in apparatuses embodying the present invention.

Figure 11:
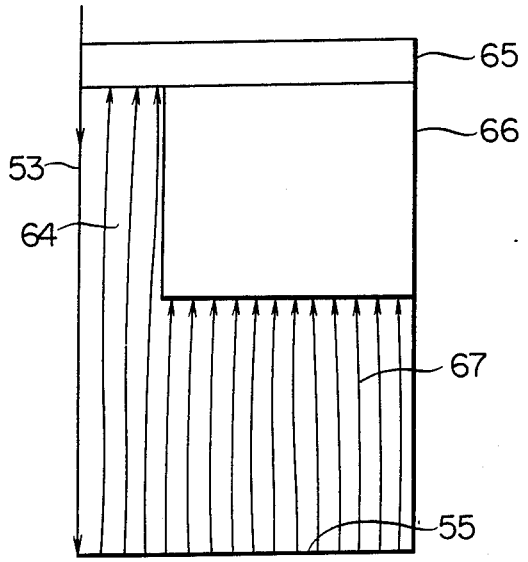
FIg. 11 is a schematic diagram of an embodiment of a transparent conductive film forming an electrode in accordance with the invention.

FIG. 11 illustrates a plane transpatent conductive membranous film 65, whose bottom side is a conductive surface, positioned in a dielectric slit unit 66 on the side of the dust-proof glass. In this drawing the electric field under the slit 64 is almost similar and parallel to the electric filed between the dielectric slit member 66 and the photoreceptor 55. Therefore, the effects of preventing toner from splashing and of pushing back splashes of toner can be expected even under the slit 64.

Figure 12:
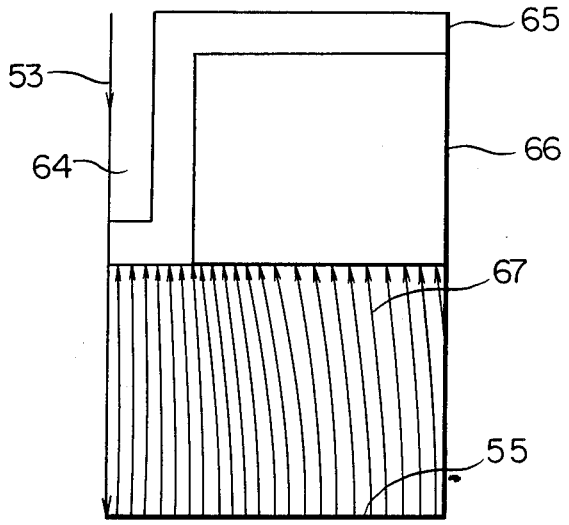
FIG. 12 is a schematic diagram of an embodiment of a transparent conductive film forming an electrode in accordance with the invention.

FIG. 12 is an example wherein a transparent conductive membranous film 65 is so positioned at the mouth of the slit 64 as to share the same plane as the bottom surface of the dielectric slit member 66.

Since, in this example, the transparent conductive membranous flim at the slit 64 is nearer to the photoreceptor than other parts, the electric field formed under the slit 64 is stronger than the electric field under the dielectric slit member 66, and the electric field assumes a slanting direction lower to the right as its positon becomes distant from the position of the center line of the slit 64. Therefore, the effects of preventing toner from splashing and of pushing back splashes of toner toward the photoreceptor is felt most strongly under the slit 64, and moreover, with an effect to push away splashes of toner toward outside from under the slit 64.

Figure 13:
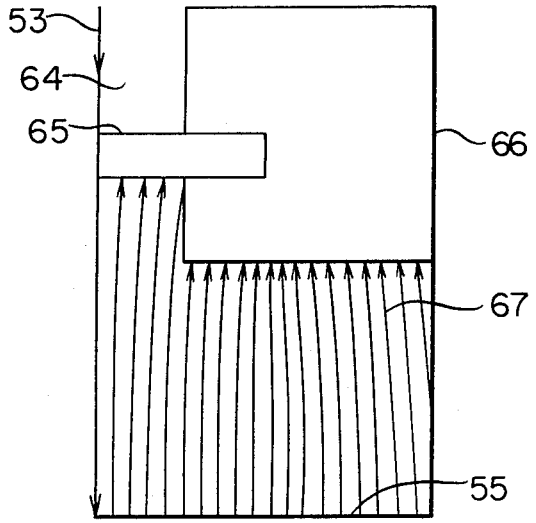
FIg. 13 is a schematic diagram of an embodiment of a transparent conductive film forming an electrode in accordance with the present invention.

FIG. 13 shows an example wherein a transparent conductive membranous film 65 is placed at an intermediate position in the direction of light passage of the slit 64.

The electric field under the slit 64 is almost parallel to that under the dielectric under the slit 64 is almost parallel to that inder the dielectric slit 66, but the electric field is slanted in a direction inclined lower to the right at positions outside from under the transparent conductive membranous film, and the effects of preventing toner from splashing and of pushing back splashes of toner at positions under the slit 64 is more noticeable than in the example in FIG. 11.

Figure 14:
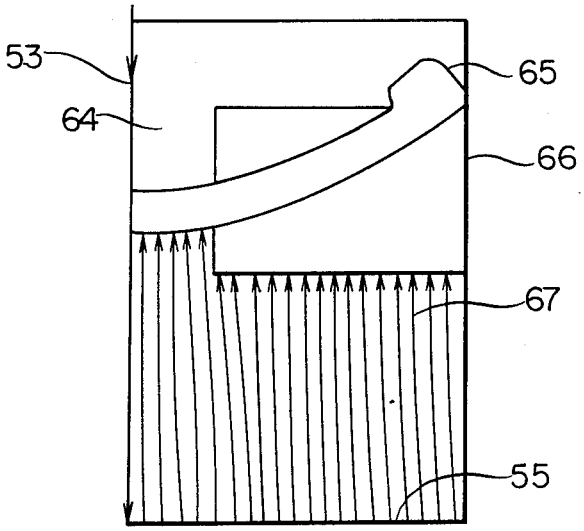
FIG. 14 is a schematic diagram of an embodiment of a transparent conductive film forming an electrode in accordance with the present invention.

FIG. 14 is an example wherein a transparent conductive membranous film 65 is curved. The electric field under the slit 64, being parallel at the center, is most strong at the center, and assumes a slanting direction inclined to the right at positions apart from the center. Therefore, the effects of preventing toner from splashing and of pushing back splashes of toner toward the photoreceptor is most strong under the slit 64 and there is also an effect to push away splashes of toner from under the slit 64.

There is now explained the functions of an image-forming apparatus showing in FIGS. 11 through 14. Since there is a slit member placed between the dust-proof glass in the image exposure unit and th ephotoreceptor and narrowing the gate of the slit, the quantity of splashes of toner which reach the passageway of light in the slit reduced compared with the cases where there are no slit members.

And, since there is a transparent conductive membranous film provided as an electric pole which blocks up the slit of the slit member and forms an electric field between itself and a certain range of the surface of the photoreceptor, an electric field can be formed inside the slit or at the mouth of the slit or near the opposing surface of the photoreceptor and toner can be prevented from splashing from the positions under exposure where toner splashes most and a force to draw back any toner that has once splashed away acts so as to prevent toner from reaching the mouth of the slit or from entering the slit.

The transparency does not raise any problem with respect to transmission of the light of exposure. When, furthermore, the transparent conductive membranous film has a shape which is most similar to the surface of the photoreceptor at the slit, the electric field between the slit and the photoreceptor, at the position where toner splashes most violently, becomes strongest compared with other parts. Since the position of the transparent conductive membranous film is distant from the photoreceptor at positions other than at the slit, the electric field formed between the transparent conductive membranous film and the surface of the photoreceptor is not all parallel field under the transparent conductive membranous film but the electric field at the slit has an element that departs toward the outside at a right angle with the passageway of light as the center therefrom. For this reason, splashes of toner are not pushed back toward the surface of the photoreceptor but receive a force which pushes them dowward of the slit member from under the slit, so that the splashes of toner at the lower part of the slit can be eliminated therefrom.

Since, a transparent conductive membranous film is provided for a certain range in such a manner as to close the slit, splashes of toner can be shut off physically completely from attaching to the dust-proof glass in the image exposure unit, and an electric field can be formed inside the slit, at the mouth of the slit, and at the lower part of the slit so that toner can be prevented effectively from splashing at the points of image exposure where the toner splashes most violently. Also, toner that has once splashed can be pushed back toward the photoreceptor or toward the bottom of the slit member, and consequently, toner is prevented from attaching to the transparent conductive membranous film itseft so that an image of good quality, without involving decrease of the amount of exposure or unevenness of exposure, can be formed.

It will be apparent to those skilled in the art that various modifications and variations can be made in the image forming method and apparatus of the present invention without departing from the scope and spirit of the invention. Thus, it is intended that the present invention cover the modifications and variations of this invention provided they come within the scope of the appended claims and their equivalents.

Figure 1A:
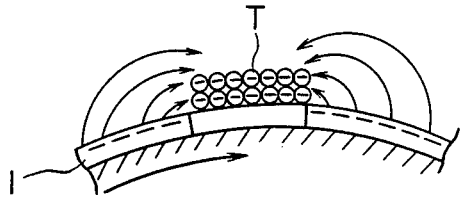
FIG. 1 is a schematic block diagram of an apparatus and process of the prior art for a multi-color image forming process.
Figure 1B:
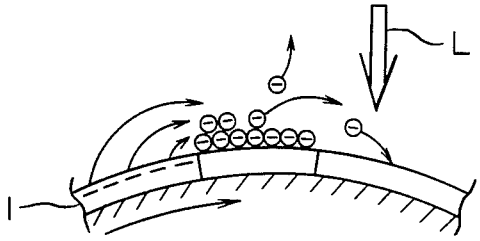
Figure 1C:
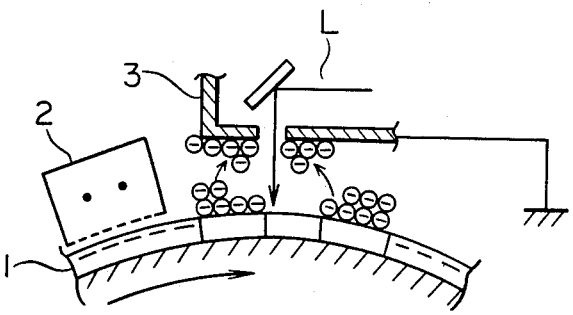
Figure 2:
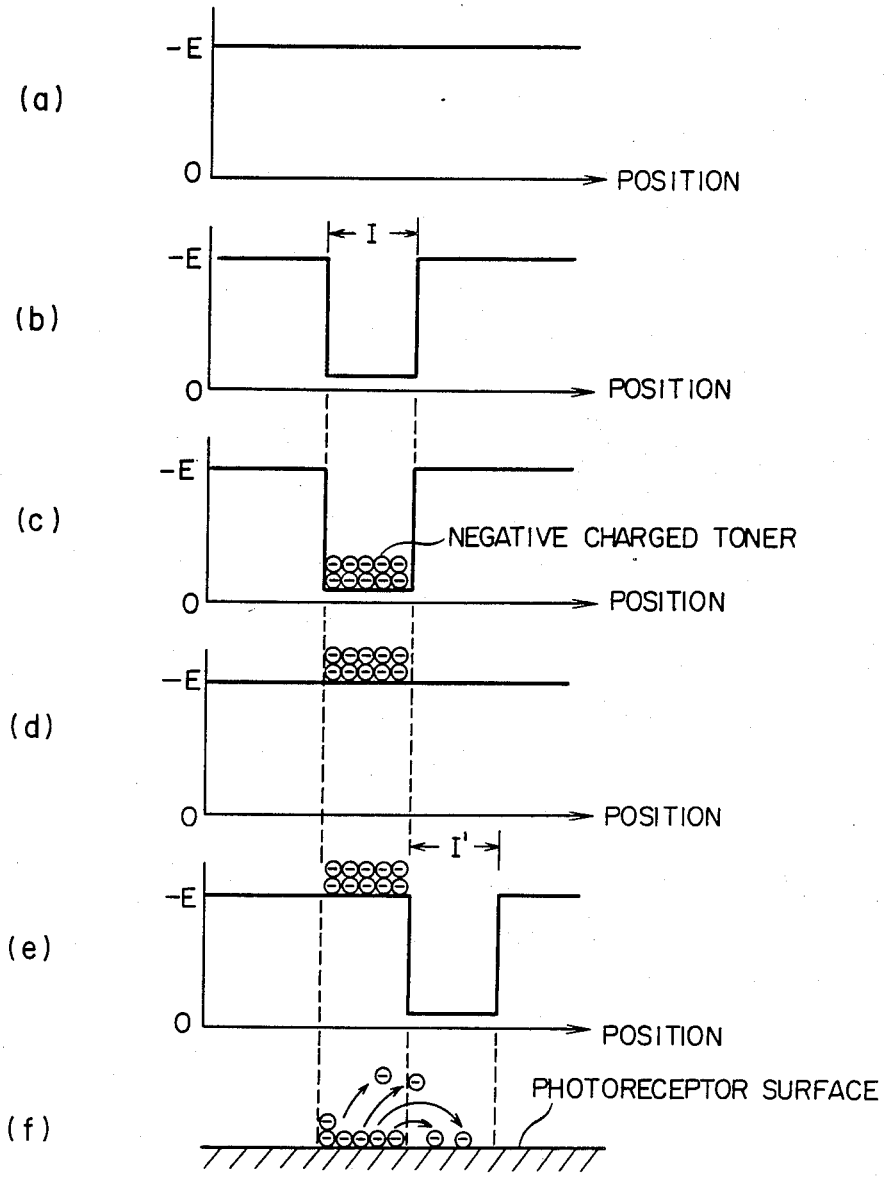
FIG. 2 is a graphical representation of multiple exposure of a photoreceptive surface and the deposition of toner thereon of the prior art.

Lastly, in FIGS. 1 and 2, the larger the layer thickness of the toner image becomes, the heavier the splashing tendency of the toner being upper layer becomes.

For this tendency, the electric pole for preventing toner from splashing according to the invention is quite effectable.

What is claimed is:

1. An image forming method for forming an image of toner particle comprising:

charging a surface of a photoreceptor, exposing the surface of the photoreceptor to exposure light, developing the surface of the photoreceptor, repeating said charging, exposing and developing at least once, and establishing an electric field to prevent toner particles on the surface of the photoreceptor from splasing when said exposing is done in presence of a toner image on the surface of the photoreceptor.

2. An image forming method as recits in claim 1, wherein said step of exposing is done by scanning a light spot.

3. An image forming method as recited in claim 2, wherein said developing is done by disposing toner particles on the photoreceptor that are attracted to the area of the photoreceptor exposed to the exposure light.

4. An image forming apparatus for forming an image of toner particles on a surface of a photoreceptor comprising:

charging means for charging the surface of the photoreceptor;

exposure means for exposing the surface of the photoreceptor to exposure light;

one or more developing means for supplying toner particles to the surface of the photoreceptor, said one or more developing means each supplying toner particles of different colors; and electrode means spaced from the photoreceptor being operable to establish an electric field between said electrode means and the photoreceptor to repel toner particles from said electrode means.

5. An image forming apparatus as recited in claim 18, wherein said electrode means has a voltage of the same polarity as the toner particles.

6. An image forming apparatus for forming an image of toner particels on a surface of a photoreceptor comprising:

charging means for cahrging the surface of the photoreceptor, exposure means for exposing the surface of the photoreceptor to exposure light.

one or more developing means for supplying toner particles to the surface of the photoreceptor, electrode means being operable to establish an electric field between said electrode means and the photoreceptor to repel toner particles from said electrode means, dielectric means having a slit through which the exposure light to pass, and said electrode means and said dielectric means being disposed between the exposure means and the photoreceptor.

7. An image forming apparatus as recited claim 6, wherein said electrode means is disposed between said dielectric means and said exposure means.

8. An image forming apparatus as recited calim 6, wherein said electrode means is disposed between said dielectric means and the photoreceptor.

9. An image forming apparatus as recited in claim 6, wherein said exposure means includes a dust-proof glass through with the exposure light propagates.

10. An image forming apparatus as recited claim 6, wherein at least one portion of said electrode means is disposed in said dielectric means.

11. An image forming apparatus as recited claim 10, wherein said dielectric means is slidably removable from the image forming apparatus.

12. An image forming apparatus for forming an image of toner particles on a surface of a photoreceptor comprising:

charging means for charging the surface of the photoreceptor, exposure means for exposing the surface of the photoreceptor to exposure light, one or more developing means for supplying toner particles to the surface of the photoreceptor, dielectric means having a slit through which the exposure light to pass, a transparent conductive film covering at least said slit and being operable to establish an electric field between said transparent conductive film and the photoreceptor to repel toner particles from said transparent conductive film, and said dielectric means and said transparent conductive film being disposed between the exposure means and the photoreceptor.

13. An image forming apparatus as recited in claim 12, wherein said exposure means includes a dust-proof glass through which the exposure light propagates.

14. An image forming apparatus as recited in claim 12 wherein at least one portion said transparent conductive film is disposed in said dielectric means.

15. An image forming apparatus as recited in claim 12, wherin said transparent conductive film is structurally level.

16. An image forming apparatus as recited in claim 12, wherein said transparent conductive film is structurally closest to the surface of the photoreceptor at said slit.

* * * * *

UNITED STATES PATENT AND TRADEMARK OFFICE

CERTIFICATE OF CORRECTION

PATENT NO. : 4,843,425

DATED : June 27, 1989

INVENTOR(S) : Masahiko Itaya et al

It is certified that error appears in the above-identified patent and that said Letters Patent is hereby corrected as shown below:

Claim 6, column 12, line 5, change "particels" to --particles--.

Claim 6, column 12, line 7, change "cahrging" to --charging--.

Signed and Sealed this

Sixteenth Day of October, 1990

*Attest:*

HARRY F. MANBECK, JR.

*Attesting Officer*

*Commissioner of Patents and Trademarks*